US005924463A

United States Patent [19]

Hsu et al.

[11] Patent Number: 5,924,463

[45] Date of Patent: Jul. 20, 1999

[54] PORTABLE EMERGENCY INSTANT INFLATION DEVICE

[76] Inventors: Chung Yeh Hsu; Allen Tso-Chiang Fan, both of P.O. Box 82-144, Taipei, Taiwan

[21] Appl. No.: 08/998,982

[22] Filed: Dec. 29, 1997

[51] Int. Cl.[6] ..... B65B 1/04

[52] U.S. Cl. ..... 141/313; 141/38; 141/19

[58] Field of Search ..... 141/9, 19, 38, 141/98, 100, 329, 313; 137/223

[56] References Cited

U.S. PATENT DOCUMENTS 4,489,855 12/1984 Boetger ..... 141/38

*Primary Examiner*—Steven O. Douglas
*Attorney, Agent, or Firm*—A & J

[57] ABSTRACT

A portable emergency instant inflation device includes a box and a fastening plate with slots. The upper side of the box is provided with fastening hooks for engaging slots of the fastening plate. An inflation tube is formed at one end of the box. A tie string extends from the other end of the box to connect to a pull ring. A partition plate with through holes is disposed inside the box to divide the interior of the box into upper and lower spaces. The upper space contains a sac filled with citric acid solution while the lower space is filled with soda powder. The lower space further communicates with the inflation tube, which is internally provided with a valve flap. A slide cutter is further disposed in the upper space and has cutting edges slightly abutting the sac. The slide cutter is connected to the tie string via a cutter mount. When the pull ring is pulled, the slide cutter is actuated to slidably cut open the sac so that the citric acid solution flows out into the lower space to mix with the soda powder to produce a large amount of carbon dioxide gas, forcing the valve flap to open, thus allowing the high pressure gas to escape through the inflation tube into an object to be inflated.

2 Claims, 4 Drawing Sheets

PORTABLE EMERGENCY INSTANT INFLATION DEVICE

BACKGROUND OF THE INVENTION

1. Field of the Invention

The present invention relates to an inflation device, and more particularly to a portable emergency instant inflation device.

2. Description of the Prior Art

Inflatable objects such as life rings and inflatable boats are convenient to carry due to their light weight. But if no inflation or pumping device is available, it will be difficult to inflate an inflatable object. While it is possible to inflate a life ring by blowing air into it it is impossible to inflate an inflatable boat in this way. Even if a conventional inflation or pumping device is used, it will take quite some time to fully inflate the inflatable boat. For car tires, they may require specialize pumping devices. Inflation or pumping devices are often bulky and inconvenient to carry. Therefore, people will usually inflate the inflatable in advance rather than carrying the inflation or pumping devices with them when going out.

SUMMARY OF THE INVENTION

The present invention relates to an inflation device, and more particularly to a portable emergency instant inflation device.

Therefore, a primary object of the present invention is to provide a portable emergency instant inflation device which is as small as a cigarette box and is provided with a fastening plate to allow the device to be attached to a belt or string to facilitate carrying.

Another object of the present invention is to provide a portable emergency inflation device, wherein a box contains both a sac filled with citric acid solution and soda powder which, when mixed, produce a large amount of carbon dioxide gas for inflation purposes. The device of the present invention does not require supply of electricity. Besides, the pressure inside the device is normal when not in use, so that there is no risk of explosion.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
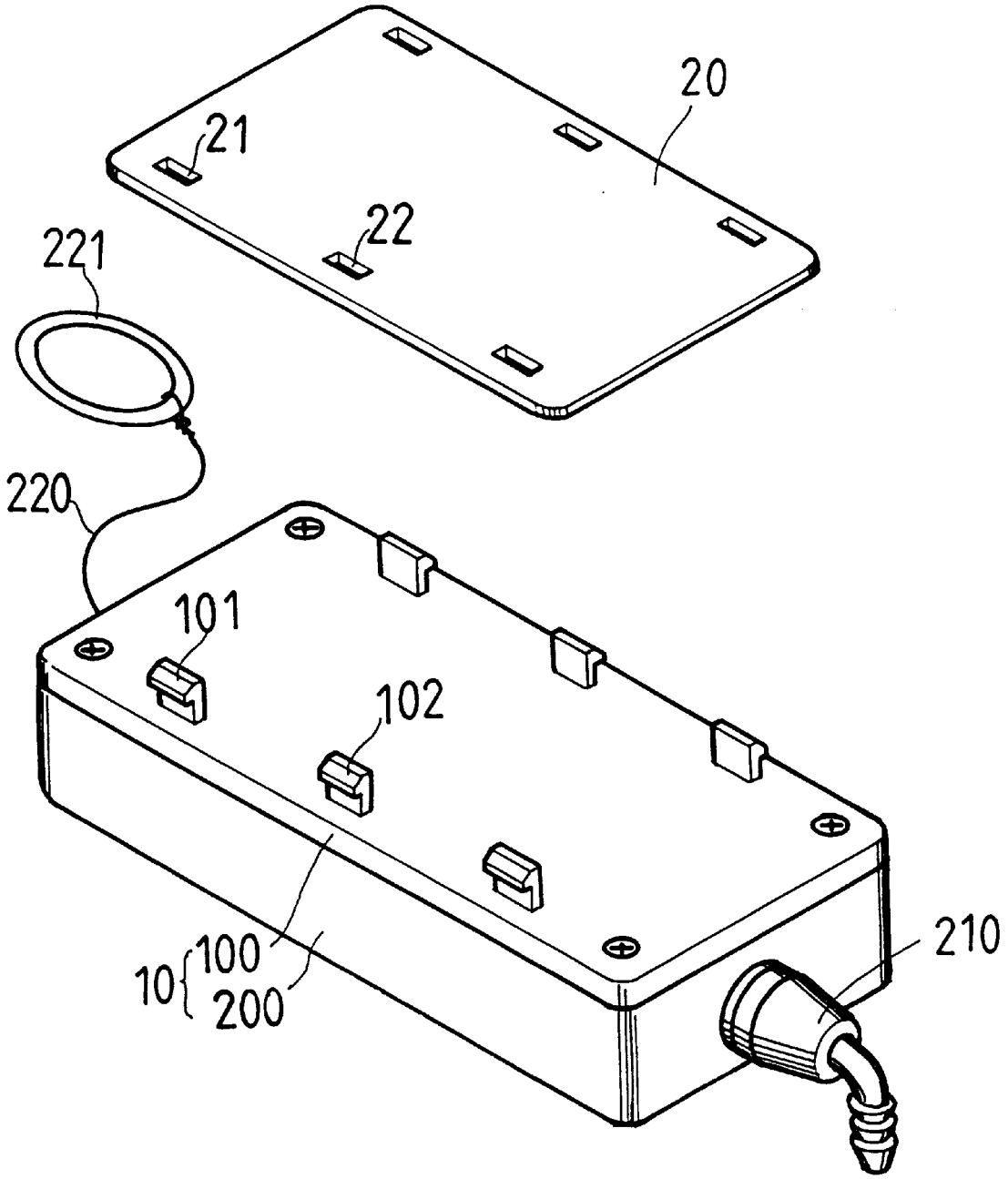
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles or the invention as illustrated herein being contemplated as would normally occur to one skilled in the art to which the invention relates.

Figure 2:
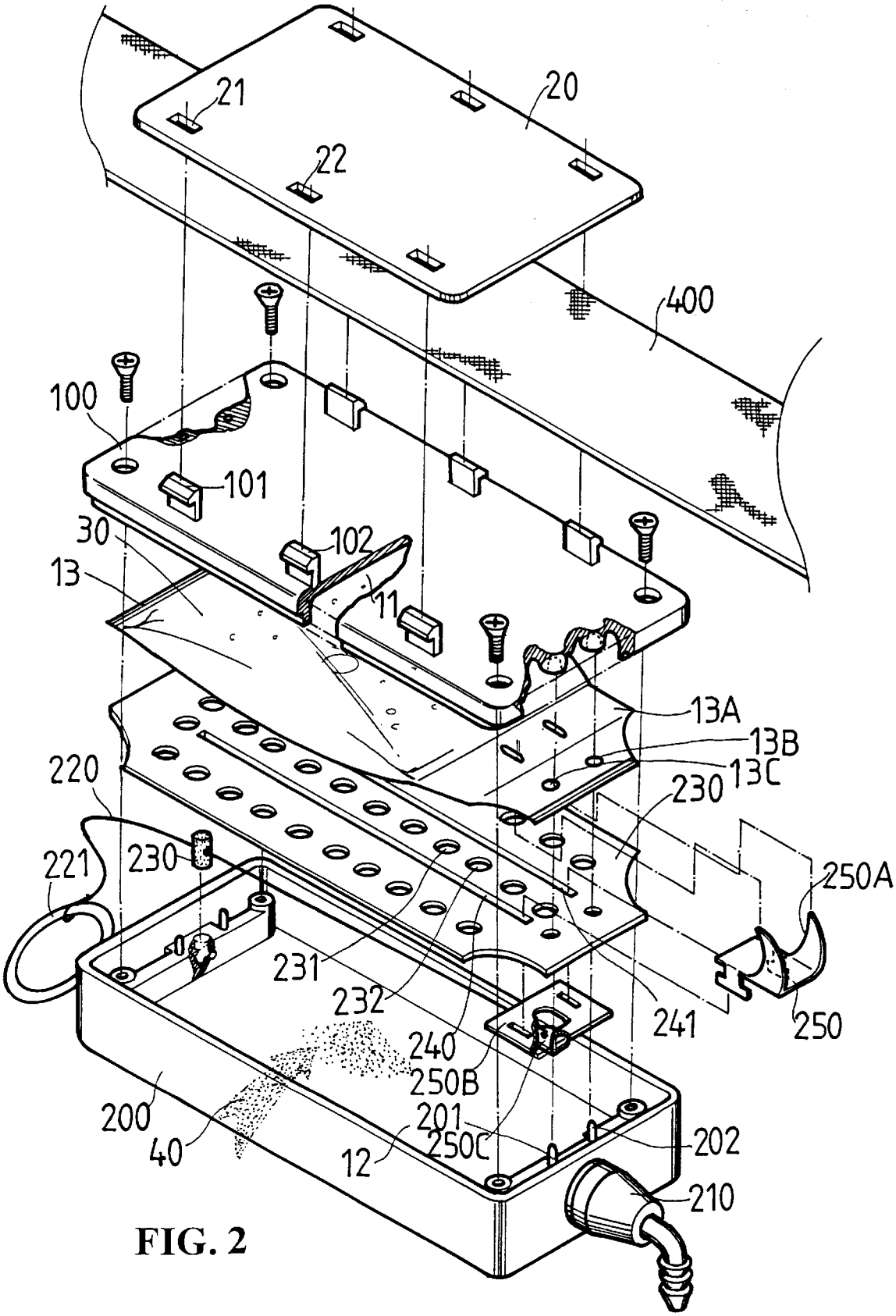
FIG. 2 is a perspective exploded view of the present invention.

Referring to both FIG. 1 and FIG. 2, the instant inflation device according to the present invention is as small as the size of a palm. It essentially comprises a box 10 and a fastening plate 20 connected to the box 10. The box 10 may be configured to include a cover 100 and a body 200 in tight closure. One end of the body 200 is externally connected to an inflation tube 210. A tie string 220 extends from the opposite end of the body 200 and is connected to a pull ring 221. An upper side of the cover 100 is provided with a plurality of fastening hooks 101, 102, . . . . The fastening plate 20 in turn is provided with a plurality of slots 21, 22, . . . for receiving the fastening hooks 101, 102, . . . , thereby the cover 20 may be secured on the box 10 with a gap therebetween. The gap allows the box 10 to be attached to a strip-like object 400 such as a belt or string to facilitate carrying. A partition plate 230 having a plurality of through holes 231, 232, . . . is disposed inside the box body 200 to divide the interior of the box body 200 into an upper space 11 and a lower space 12. A sac 13 filled with citric acid solution 30 is disposed in the upper space 11. One end of the sac 13 is provided with an extended portion 13A having slits and positioning holes 13B and 13C. Pins 201 and 202 are provided at a corresponding end of the box body 200 for engaging the positioning holes 13B and 13C of the sac 13 so as to position the sac 13 in place. The lower space 12 is filled with soda powder 40 and communicates with the inflation tube 210 formed externally at one end of the box and is connected to a pull ring 221. An upper side of the cover 100 is provided with a plurality of fastening hooks 101, 102, . . . . The fastening plate 20 in turn is provided with a plurality of slots 21, 22, . . . for receiving the fastening hooks 101, 102, . . . , thereby the cover 20 may be secured on the box 10 with a gap therebetween. The gap allows the box 10 to be attached to a strip-like object 400 such as a belt or string to facilitate carrying. A partition plate 230 having a plurality of through holes 231, 232, . . . is disposed inside the box body 200 to divide the interior of the box body 200 into an upper space 11 and a lower space 12. A sac 13 filled with citric acid solution 30 is disposed in the upper space 11. One end of the sac 13 is provided with an extended portion 13A having slits and positioning holes 13B and 13C. Pins 201 and 202 are provided at a corresponding end of the box body 200 for engaging the positioning holes 13B and 13C of the sac 13 so as to position the sac 13 in place. The lower space 12 is filled with soda powder 40 and communicates with the inflation tube 210 formed externally at one end of the box body 200. The partition plate 230 is further provided with slide grooves 240, 241 for mounting a slide cutter 250. The cutting edges 250A of the cutter 250 pass through the slits of the extended portion 13A of the sac 13 to slightly urge against the wall of the sac 13. The slide cutter 250 further has engaging leg portions insertable through the slide grooves 240 and 241. A cutter mount 250B having slots for receiving the leg portions of the slide cutter 250 is mounted below the partition plate 230. The cutter mount 250B is provided with a ring 250C to which the string 220 may be tied. The string 220 extends to a distal end of the sac 13 and out of the box body 200 to be tied to the pull ring 221. in order to ensure air tightness at where the string 220 extends from box body 200 to the outside, a soft nylon rubber insert block 230 with a through hole may be inserted into the wall of the box body 200 at that end. The string 220 may then be passed through the through hole of the insert block 230 without affecting the air tightness of the box body 200 or the pulling of the string 220.

Figure 3:
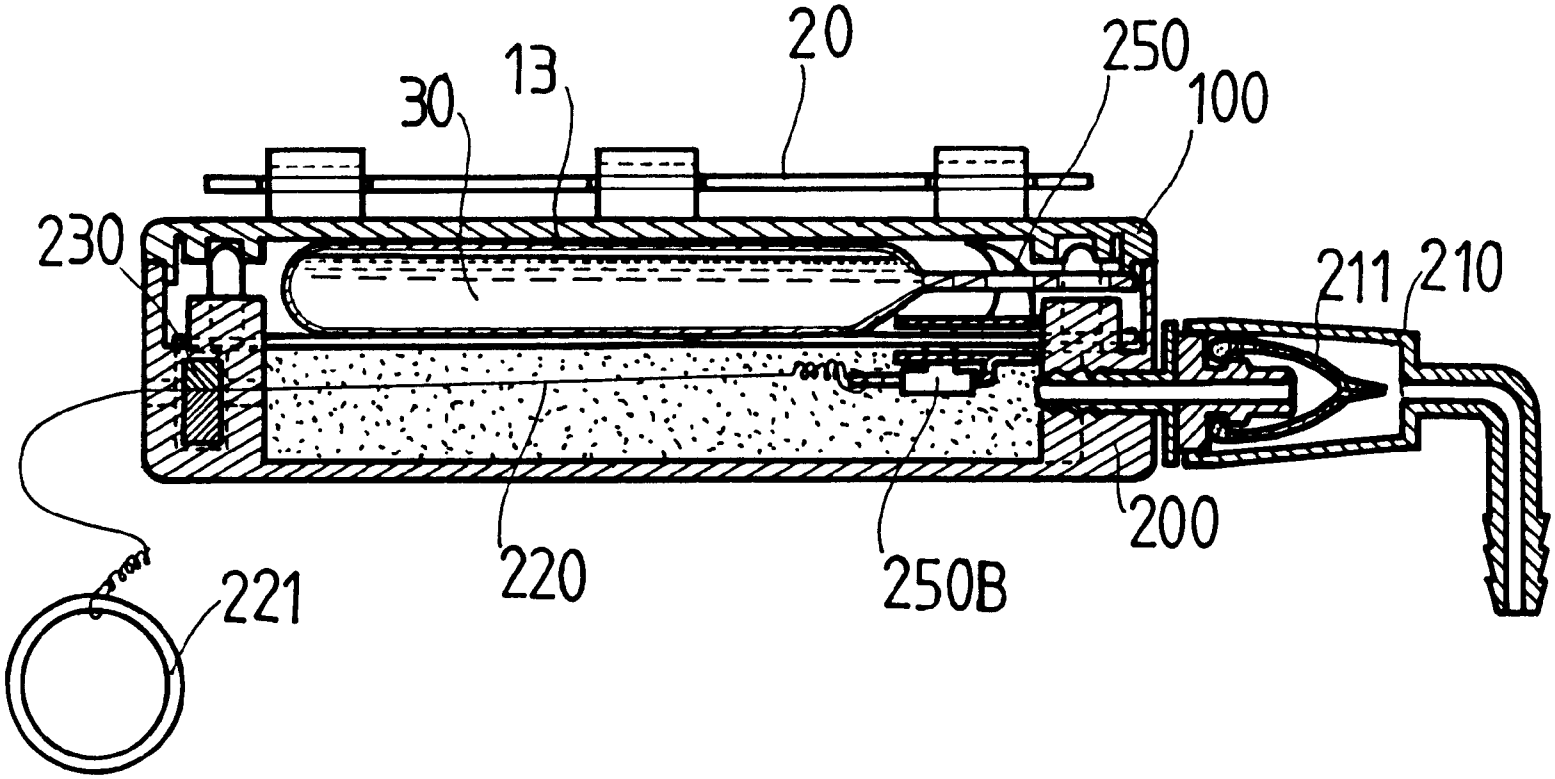
FIG. 3 is a sectional view of the present invention.
Figure 4:
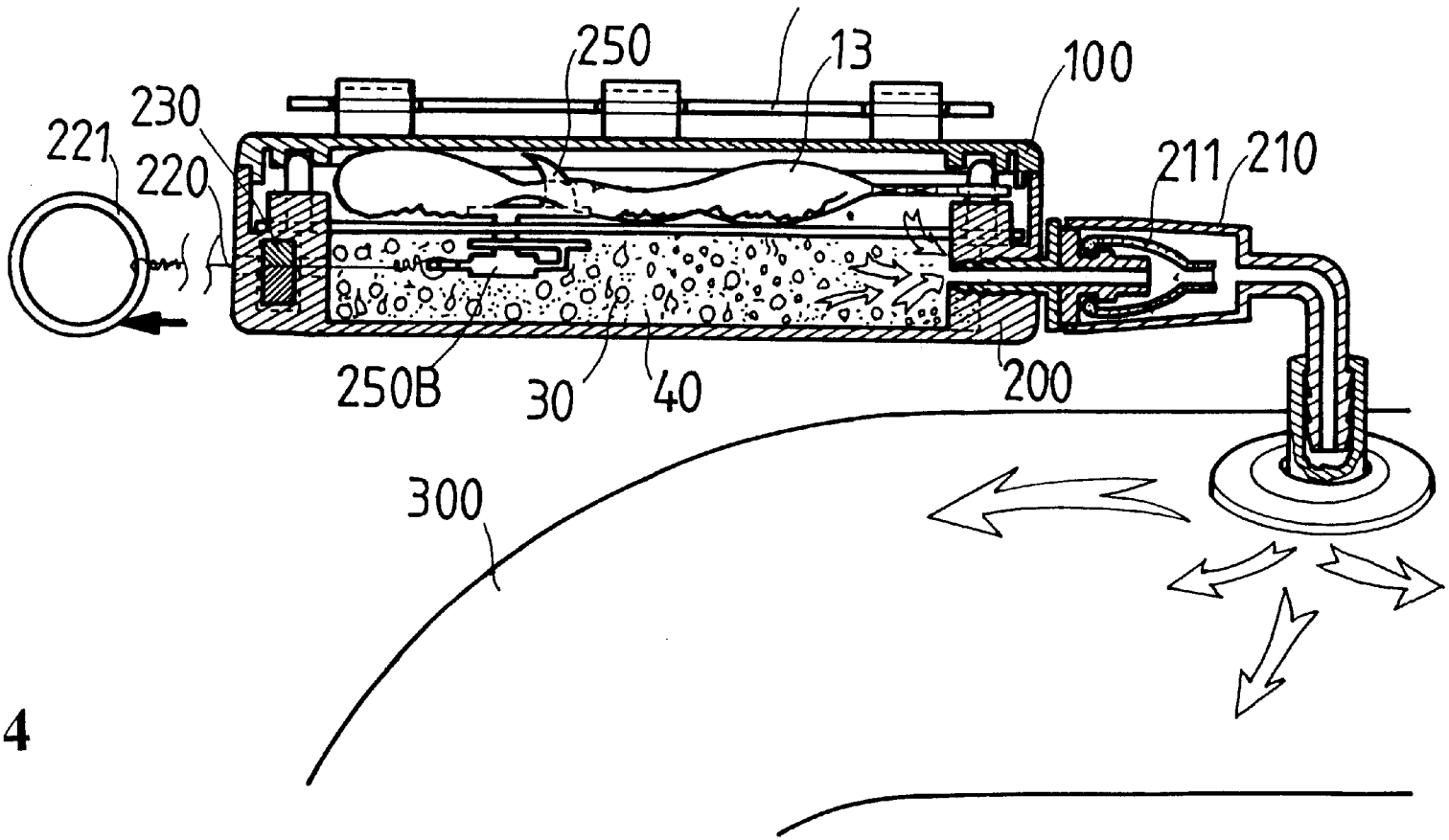
FIG. 4 is a sectional view illustrating operation of the present invention.

FIG. 3 shows the invention in an assembled state. As shown, the inflation tube 210 is internally fitted with an elastic valve flap 211 which is made from very elastic and tough materials. Under normal circumstances, the valve flap 211 will remain closed due to its own elasticity. When the air pressure inside the box body 200 rises, the valve flap 211 will automatically spring open to allow communication between the inflation tube 210 can communicate with the lower space 12, thereby permitting high pressure air to escape through the inflation tube 210. In use, the user has to pull the pull ring 221 so that the string 220 pulls the slide cutter 250 to cut open the sac 13 inside the box body 200. The citric acid solution 30 inside the sac 13 will then flow out and through the through holes 231, 232, . . . into the lower space 12 to mix the soda power 40 therein, thus generating a large amount of carbon dioxide gas, the pressure of which forces the valve flap 211 to open, allowing the high pressure air to escape in jets through the inflation tube 210 into an object 300 to be inflated, such as a life ring or inflatable boat.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A portable instant inflation device, comprising:

a fastening plate having a plurality of slots; and a box, said box having one end forming an inflation tube, a tie string extending from the other end of said box to connect to a pull ring, an upper side of said box being provided with a plurality of fastening hooks for engaging said slots of said fastening plate to allow coupling of said fastening plate to said box, said box further having a partition plate having a plurality of through holes disposed therein to divide the interior of said box into an upper space and a lower space, said upper space accommodating a sac filled with citric acid solution while said lower space is filled with soda powder, said lower space communicating with said inflation tube, said inflation tube being internally provided with an elastic valve flap, said partition plate being further provided with a slide cutter having cutting edges slightly abutting said sac and being mounted on a cutter mount, said tie string being fastened to said cutter mount at one end and extending to a distal end of said sac to be connected to said pull ring at the other end of said box, whereby when said pull ring is pulled, said slide cutter may be actuated to slit open said sac so that the citric acid solution inside said sac flows out and through said through holes of said partition plate into said lower space to mix with the soda powder to thereby generate a large amount of carbon dioxide gas, which forces said valve flap to open to allow communication between said lower space and said inflation tube so that the gas can escape through said inflation tube into an object to be inflated.

2. The device as claimed in claim 1, wherein said box includes a cover and a box body in tight closure, one end of said box body being provided with said inflation tube, the other end having said tie string extending therefrom to connect to said pull ring, said cover having an upper side provided with a plurality of fastening hooks for engaging said slots of said fastening plate, said partition plate having through holes being disposed inside said box body to divide the interior of said box body into upper and lower spaces, said sac further having an extended portion provided with positioning holes, said box body having pins extending upwardly to engage said positioning holes of said sac to secure sac sac in position.

* * * * *